United States Patent [19]

Hoage et al.

[11] Patent Number: 4,903,597

[45] Date of Patent: Feb. 27, 1990

[54] PRINTING SLEEVES AND METHODS FOR MOUNTING AND DISMOUNTING

[75] Inventors: Carlton A. Hoage, Vancouver, Wash.; Mark A. Borski, Gresham, Oreg.

[73] Assignee: LaValley Industries, Inc., Vancouver, Wash.

[21] Appl. No.: 261,501

[22] Filed: Oct. 24, 1988

[51] Int. Cl.[4] ..... B41C 1/00

[52] U.S. Cl. ..... 101/401.1; 101/375; 29/113.1

[58] Field of Search ..... 101/375, 376, 401.1, 101/382 MV; 29/113.1, 113.2, 148.4 D

[56] References Cited

U.S. PATENT DOCUMENTS

| | | | |
|---|---|---|---|
| 3,043,211 | 7/1962 | Appenzeller | 29/113.2 |
| 3,146,709 | 9/1964 | Bass et al. . | |
| 3,978,254 | 8/1976 | Hoexter et al. . | |
| 4,030,415 | 6/1977 | Fellows | 29/113.1 |
| 4,089,265 | 5/1978 | White et al. . | |
| 4,119,032 | 10/1978 | Hollis | 101/375 |
| 4,144,812 | 3/1979 | Julian | 101/375 |
| 4,144,813 | 3/1979 | Julian | 101/375 |
| 4,381,709 | 5/1983 | Katz | 29/113.1 |
| 4,554,040 | 11/1985 | Vandervelden | 101/375 |
| 4,794,858 | 1/1989 | Katz | 29/113.1 |

FOREIGN PATENT DOCUMENTS

| | | | |
|---|---|---|---|
| 0107845 | 7/1982 | Japan | 101/375 |

*Primary Examiner*—Eugene H. Eickholt
*Attorney, Agent, or Firm*—Marger & Johnson

[57] ABSTRACT

A unitary, cylindrically-shaped printing sleeve is provided which is readily axially mountable on and dismountable from a complementary cylindrically-shaped printing cylinder. The subject printing sleeve comprises a printing sleeve body having a substantially constant cross-sectional diameter and a wall thickness of at least about 0.015 inches. The sleeve is substantially airtight when mounted onto the printing cylinder, and has substantially seamless inner and outer cylindrically-shaped wall surfaces. The diameter of the printing sleeve is expandable by the introduction of a low fluid pressure level between the inner printing sleeve wall surface and the outer wall surface of the printing cylinder of not more than about 100 psi at ambient temperature. The printing sleeve is contractable by the removal of the low pressure fluid.

36 Claims, 1 Drawing Sheet

PRINTING SLEEVES AND METHODS FOR MOUNTING AND DISMOUNTING

BACKGROUND OF THE INVENTION

This invention relates to printing sleeves which are readily mountable onto and dismountable from printing cylinders, and more particularly to printing sleeves which are expandably mountable and dismountable employing a pressurized gas.

In past printing operations, flexible printing plates were mounted onto the outer surface of a printing cylinder. These plates were used for printing of ink images onto a printing medium. Typically, the back of the plates was adhered directly to the printing cylinder. Since these plates were not readily interchangable from one cylinder to another, the use of a multiplicity of printing cylinders to perform a multiplicity of jobs was required. This presented severe storage and cost problems to the end user.

Therefore, in an effort to overcome this problem, printing sleeves were developed which were mountable onto and dismountable from the printing cylinders. Compressed gas, generally compressed air, passing in a substantially radial direction from holes located within the printing cylinders, was used to expand the sleeve to a limited extent for facilitating the mounting and dismounting operations.

The first patent to describe this latter mode of mounting and dismounting of a printing sleeve was U.S. Pat. No. 3,146,709. In that patent, a "wound" printing sleeve, i.e., a helically wound paper sleeve, was fitted onto a hollow printing sleeve. The printing sleeve was used as a carrier roll for rubber printing plates attached thereto. Air pressure was radially applied through the holes in the external surface of the printing cylinder for limited expansion of the sleeve. The sleeve was then axially mounted onto the printing cylinder by moving the cylinder to an upright position and filling the internal chamber of the cylinder with compressed air. As the sleeve was moved over the upper end of the cylinder, the exiting air expanded the sleeve and a lubricating air film was interposed between the inner sleeve and the outer cylinder. This air film permitted the axial movement of the sleeve to a position about the cylinder. When the sleeve was in such a position, the air flow was terminated, and the sleeve contracted in place about the cylinder.

However, difficulty has been encountered when wound sleeves are employed since expansion does not effectively take place unless high pressure air, substantially higher than the 50–100 psi air generally available in production facilities, is radially conveyed between the sleeve and the printing cylinder to facilitate the mounting and dismounting operation. This expandability problem occurs because of the thickness of the sleeve walls and the nature of the materials of construction. If pressures above the available air pressure at the production facility are required to expand the sleeve, auxiliary sources of compressed air must be purchased. For example, in printing operations where sleeve thicknesses of about 0.015" or greater are required, such as in the process printing industry, wound sleeves cannot readily be employed because they do not undergo the requisite expansion using available production compressed air. Furthermore, these wound sleeves cannot be effectively used because of the leakage problems inherent in their design, which in this case, U.S. Pat. No. 3,146,709, comprises a polyester film held in position by helically-wound paper tape. This type of construction forms a leakage path for the air and reduces the effectiveness of the lubricating fluid.

In order to overcome the problems inherent in the U.S. Pat. No. 3,146,709 wound printing sleeve, U.S. Pat. No. 3,978,254 has provided a mechanically adhered wound printing sleeve in which three layers of adhesive tape are helically wound about a mandrel to form a carrier sleeve, with two of the helixes being wound at the same angle and the remaining helix being wound at a different angle. The convolution of the helixes are said to impart some degree of strength, rigidity and leakage protection to the printing sleeve. Neither of the printing sleeves of U.S. Pat. No. 3,146,709 or U.S. Pat. No. 3,978,254 is unitary in construction, but is instead fabricated of a composite of wound materials. Furthermore, the outer surface of the U.S. Pat. No. 3,978,254 wound sleeve has a plurality of surface irregularities formed therein and is therefore not "round" to the extent required by the flexographic printing industry. These carrier sleeves are made of a flexible, thin tape material which provides a minimum of structural integrity which exhibit minimal strength and durability properties. Moreover, as the printing plates are adhered to the printing sleeve they are moved from one position to another as they are aligned on the plate surface. In order to trim excess material from the plate from the sleeve surface, they must be cut with a sharp instrument such as a knife. The synthetic plastic tape used to form the above-described sleeve cannot withstand even the minor cutting action required in positioning of the printing plates.

Another type of printing sleeve is one which is made of a metallic material. As in the case of wound sleeves, metallic sleeves are not readily expandable and therefore must have a wall thickness which is be quite thin, i.e., thicknesses of up to only about 0.005", in order to be capable of undergoing the limited expansion required of printing sleeves. As indicated above, this minimum thickness level required of metallic sleeves is a problem in applications such as process printing and the like. Moreover, printing metallic sleeves are not durable and are readily damages. For instance, they can easily form kinks in their outer surface when they are stored without being supported by a printing cylinder.

Dimensional stability is a problem in printing applications requiring that the outer surface of a printing sleeve structure have a true cylindrical shape. In some cases, this true cylindrical shape must even be within a 0.001"–0.0025" tolerance level in order to be acceptable in, for example, uses such as in the process printing industry. The outer printing surface in these applications must accurately conform to a uniformly constant, cylindrical outer shape in order to accurately imprint a print image onto a printing medium. Many of these prior art printing sleeves do not meet these requisite tolerance levels.

U.S. Pat. No. 4,144,812 and U.S. Pat. No. 4,144,813 provide noncylindrical printing sleeves and associated air-assisted printing rolls designed in a tapered or stepped-transition configuration, the change in the sleeve or printing cylinder diameter from one end to the other being progressive, i.e., increasing or decreasing according to the direction one is moving along the printing sleeve or roll. The printing roll comprises an outer surface having one end of a diameter greater than the other longitudinal end. The printing sleeve has an inner surface designed to form an interference fit with the outer surface of the printing roll only at the designated working position, and not along the entire axial uniform cross-sectional extent of the tapered sleeve.

This non-cylindrical sleeve is fabricated of a highly rigid material having a low degree of expandability. These sleeves have a thickness of about 0.015". An extremely high air pressure, in excess of 125 psi, and typically about 250 psi or higher, is thus required to be introduced as the sleeve is being fitted onto the underlying air-assisted, printing roll in order to extend the radial dimension of the printing sleeve to a position capable of achieving complete coverage of the printing cylinder by the sleeve. Complete coverage is required in this system to achieve a proper interference fit. Since a pressure in excess of 125 psi is required herein, the system must satisfy various governmental regulations relating to pressure-rated containers. Conventional cylindrically-shaped, air-assisted printing presently on hand cannot readily be retrofitted to accommodate this non-cylindrical configuration because they cannot meet the abovedescribed pressure-rating requirement. Therefore, they must be replaced, at great cost, by new non-cylindrical printing cylinders capable of meeting these government regulations.

U.S. Pat. No. 4,119,032, describes an air-assisted printing cylinder mounted in a printing machine in such a way that a printing sleeve on its outer surface can be removed axially while the roll remains substantially in its working position. One end bearing of the printing cylinder is removably secured to a side of the machine frame. For axial positioning, an adjustable restrainer engages the roll axle at that end. Beyond the other side frame a counterpoise acts on the printing cylinder axle to support the printing cylinder when one end bearing is removed.

Finally, in U.S. Pat. No. 4,089,265, a flexographic printing roll is provided comprising a rigid base tube having perforations in the form of a plurality of small apertures and a printing sleeve on the tube strained to grip the tube to retain the sleeve securely on the tube. There is no underlying printing cylinder in the conventional sense in this system.

Therefore, a need exists for a cylindrically-shaped printing sleeve which is unitary and airtight, which can be frictionally mounted onto conventional cylindrically-shaped printing cylinders having a complementary outside diameter, which is readily expandable using a low pressure fluid, and which has a wall thickness and a true outer wall surface capable of being used in process printing applications.

SUMMARY OF THE INVENTION

This invention relates to a cylindrically-shaped printing sleeve which meets the aforementioned needs and overcomes the above-described problems associated with prior art sleeves, particularly sleeves for the process printing industry.

First, the printing sleeve of the present invention comprises a printing sleeve body cylindrically-shaped having a constant cross-sectional diameter. This printing sleeve is therefore readily axially mountable on, and dismountable from, a complementary cylindrically-shaped printing cylinder having a constant cross-sectional diameter. In this way, conventional printing cylinders in use in various manufacturing facilities do not have to be replaced at great cost to the user.

The present invention provides for a printing sleeve structure having a printing sleeve body which is unitary and substantially airtight. Thus, this sleeve is strong, durable, and does not leak, all of which being problems which exist with respect to prior art wound printing sleeves. More specifically, the subject sleeves preferably have are unitary structures because they are substantially seamless inner and outer cylindrically-shaped wall surfaces, and are airtight because they are constructed of materials which are high strength and non-permeable in nature. Strength and durability are properties clearly lacking in thinwalled (0.005") metallic sleeves. The preferred printing sleeves of this invention have a wall thickness of at least about 0.015".

Mounting of the printing sleeves of the present invention onto a conventional printing cylinder can be readily accomplished by expanding the diameter of these sleeves by the introduction of a relatively low fluid pressure between the inner wall surface of the sleeve and the outer wall surface of the printing cylinder. Preferably, in the printing sleeves of this invention, each of the inner and outer wall surfaces of the printing sleeve body has a substantially constant radial diameter. The printing sleeve is contractable by removing the expanding forces.

Typically, the expanding forces are applied using a low pressure fluid, such as low pressure air and the like. The low pressure fluid is typically introduced at a pressure, at ambient temperature, of not more than about 100 psi, preferably not more than about 80 psi, and more preferably not more than about 50 psi, whereby the cross-sectional diameter of the printing sleeve is expanded for mounting of the printing sleeve onto the printing cylinder. The ability to use lower pressure gas is important since most production facilities do not have, for example, high pressure gas available for conducting the mounting and dismounting operations. Moreover, since this pressure is below 125 psi, there is no problems with government regulation as a pressure-rated container.

The printing sleeve exhibits certain preferred physical properties. These include a printing sleeve flexural modulus of at least about $6\times10^5$ lbs/in$^2$, and more preferably at least about $10\times10^5$ lbs/in$^2$. This provides excellent structural integrity but at the same time the low flexural modulus value permits the required level of expandability with the above described introduction of a relatively low pressure fluid. For purposes of this invention, flexural modulus was determined using ASTM D2412.

The printing sleeve of the present invention can also be fabricated with a wall thickness substantially greater than conventional metal printing sleeves. Preferably, this wall thickness is at least about 0.015", more preferably at least about 0.020", and most preferably at least about 0.040" . . . . In this way, printing plates having a much higher range of thicknesses can be employed. Although sleeves having a larger wall thickness can be fabricated by the teachings of this invention, a practical upper limit may be a wall thickness of about 0.120".

By employing the subject printing sleeve, a stiffness factor, can be attained of at least about $7.26\times10^5$ inch-pounds. This clearly describes a printing sleeve construction having a high level of strength and expandability. The stiffness factor was determined using ASTM D2412(10.2).

The printing sleeves of this invention is typically fabricated of a non-metallic material, preferably a polymeric material. The printing sleeves preferably comprise a reinforced non-permeable laminate structure including at least one reinforcing internal layer of a woven fabric of synthetic fibers or organic fibers, for particularly providing high tensile strength. A second internal layer may also be included which comprises at least one non-permeable internal layer, typically synthetic fibers. Preferably, the synthetic and organic fibers are of high strength, and the reinforced non-permeable internal layers comprise a non-woven fabric of synthetic fibers.

The outer wall surface of the printing sleeve exhibits a limited dimensional tolerance whereby printing plates can be mounted for complementary frictional engagement onto the outer wall surface of the printing sleeve so that the printing elements of differing colors located on the printing plate surface register within the exact specifications required for conducting process printing operations. Preferably, the printing sleeve exhibits a maximum difference in the trueness of its outer wall surface, when the sleeve is mounted on a true cylinder, is not more than about 0.005", preferably not more than about 0.0025", and most preferably not more than about 0.001".

This invention also contemplates a method for axially mounting the previously described non-metallic, airtight, unitary, cylindrically-shaped printing sleeve of constant cross-section configuration, which includes substantially seamless inner and outer cylindrically-shaped wall surfaces of constant cross-sectional diameter, onto a complementary cylindrically-shaped, printing cylinder and for dismounting the printing sleeve therefrom. This is accomplished by expanding the printing sleeve to a cross-sectional diameter slightly greater than the diameter of the printing cylinder. This can be readily accomplished because of the above-described physical properties of the sleeve. The expanded printing sleeve is then axially moved to a position onto the printing cylinder. Then, the expanded printing sleeve is contracted to form a minimum interference fit between the printing cylinder and the printing sleeve, respectively, and thereby mounting the printing cylinder onto the printing sleeve. For dismounting purposes, the sleeve is expanded, as provided above, and then axially removed from its position about the printing cylinder.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 2:
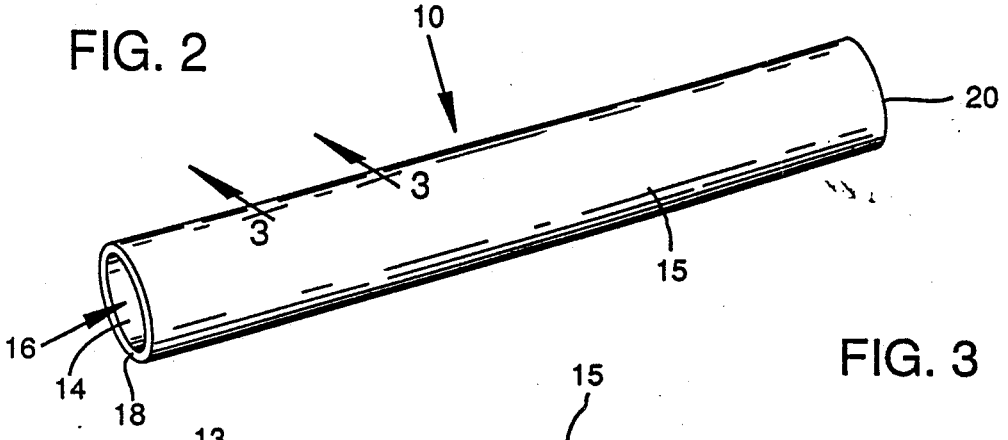
FIG. 2 is a perspective view of the cylindrically-shaped printing sleeve of FIG. 1.
Figure 1:
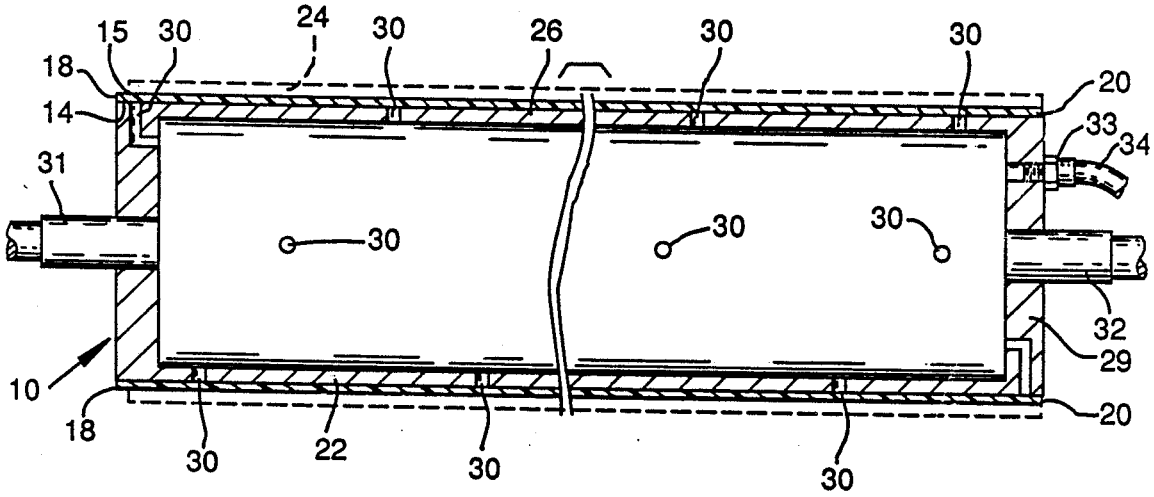
FIG. 1 is a sectional view of an enlarged, cylindrically-shaped printing sleeve of the present invention as mounted on a printing cylinder.

Referring now to FIGS. 1 and 2, a cylindrically-shaped printing sleeve 10 is provided which comprises cylindrically-shaped inner and outer walls 14 and 15 which define a hollow inner chamber 16, and a pair of end sections 18 and 20. Sleeve 10 is depicted mounted on an illustrative conventional printing cylinder 22, such as described in FIG. 3 of U.S. Pat. No. 3,146,709.

Typically, sleeve 10 will serve as a support for the application of printing plates 24, preferably flexographic printing plates (see FIG. 3 in phantom), which are generally made of a flexible polymeric material. Any suitable indicia for printing onto a printing medium may be set on these printing plates. Alternatively, outer wall 15 may itself be employed as the means for printing onto a printing medium. Various methods can be employed to engrave the outer wall 15. For example, one could employ chemical or photochemical engraving techniques to form the requisite means for printing the print indicia.

The printing sleeve 10 and the printing cylinder 22 are cylindrical and have a constant diameter. The outer wall 23 of the cylinder 22 has a slightly larger diameter than the inner wall 14 so that the sleeve will firmly frictionally fit onto the cylinder. The cylinder 22 is hollow and has a cylindrical chamber 25 which is used as a compressed air chamber. The cylinder 22 comprises a cylindrical tube 26 fitted with airtight endplates 28 and 29. A plurality of spaced-apart, radially-extending apertures 30 are provided in the tube 26 through which air from the chamber 25 may pass for expanding the sleeve 10 during mounting and dismounting operations. Air is introduced into the chamber 25 through air hose 32. Trunnions 31 and 32 are provided for rotationly supporting cylinder 22. A coupling element 33 is disposed within endplate 29 and provides a means for connecting air hose 32 to cylinder 22 for introducing compressed air to the cylinder chamber 25.

The cylindrically-shaped printed sleeve 10 typically comprises a reinforced, non-permeable laminate structure. An example of a typical formation process for producing such a reinforced non-permeable laminate printing sleeve is as follows: A typical internal steel mandrel of about 5.5 feet in length and about 1.5–15 inches in diameter is employed as the structural form in the fabrication of the reinforced non-permeable laminate printing sleeve 10. The mandrel is a cylindrically-shaped printing cylinder having a hollow internal chamber and a substantially cylindrically-shaped outer wall surface including an array of holes located in the cylinder wall. The pressurized air employed to expand a printing sleeve passes from the internal chamber outwardly through the array of air holes. In the printing sleeve formation process these air holes are first taped shut in order to prevent the synthetic resin employed in forming the printing sleeve from passing through the air holes into the central chamber of the mandrel. The diameter of the outer wall section of the printing cylinder is sized to produce a printing sleeve having an inner wall surface of substantially constant diameter, the magnitude of such inner wall being slightly smaller than the diameter of the outer wall section of the printing cylinder on which it will ultimately be mounted to promote an interference fit of the sleeve about the ultimate printing cylinder.

The printing sleeve formation process can be initiated by applying a mold-release agent such as polyvinyl alcohol and the like, onto the outer wall section of the mandrel. The use of this agent allows the sleeve to be readily removed from its position about the mandrel after the formation process has been completed. Next, a synthetic resin capable of being formed into a unitary, airtight printing sleeve body having the physical properties previously described is applied to the outer wall section of the mandrel. For example, Derakane®, a vinyl ester resin manufactured by the Dow Chemical Company, can be employed for this purpose. The catalyst used in curing the resin is a methyl ethyl ketone peroxide material, such as Hi Point 90 manufactured by Witco Chemical Corporation. The resin, when cured, has a high degree of toughness, chemical resistance, impact resistance and a high level of tensile strength.

Figure 3:
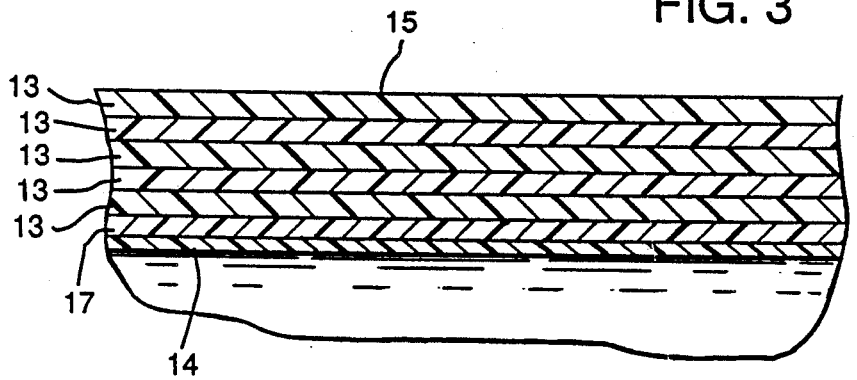
FIG. 3 is an enlarged sectional view taken along 2—2 of FIG. 2.

An internal reinforcing layer of high strength synthetic or organic fibers can then be applied about the resin material. Typically, at least one reinforcing composition layer is employed for this purpose because of its generally high strength and lightweight properties. In the preferred case, as shown in FIG. 3 a single layer 17 of a woven composite of synthetic fibers, such as aramid fibers manufactured by DuPont under the registered trademark Kevlar®, is used herein. Kevlar® is available in a number of fabric weaves. In this case, a single layer of 1.8 oz per square yard Kevlar® aramid fibers was employed as the reinforcing composite material. Alternatively, woven fiberglass filaments in the form of a composite boat cloth fabric can be employed as the internal reinforcing layer. For instance, a boat cloth composite fabric manufactured by Owens Corning can be used herein.

At least one layer of an non-permeable material, such as a non-woven, non-apertured synthetic material, is then preferably wrapped about the internal reinforcing layer. in this case, as depicted in FIG. 3, four layers of the non-woven, non-apertured material 13 were applied. A polyester non-woven polymeric web, such as Nexus®, manufactured by Burlington Industries, is useful for this purpose. This material provides the overall printing sleeve structure with machinability, shock resistance, and, when saturated with resin, provides a fluid-tight, and particularly an airtight, barrier. The remaining portion of the resinous material was then applied thereto.

Next, the completed structure was allowed to cure for a period of time so that the resin would become cured and crosslinked and dimensionally stable. This was accomplished under exothermic conditions for a period of time of about two hours. The formation mandril was continually rotated during the exothermic period. The printing sleeve was then removed from the mandril and post-cured for a period of time and at an elevated temperature. Here, the post-cure was conducted for a period of 30 minutes at a temperature of 170° F., in a post-cure oven. The printing sleeve was then removed from the oven and allowed to cool to ambient temperature.

At that time, the interference fit was checked to determine whether it was within acceptable parameters. Preferably, the interference fit of the sleeve about the printing cylinder is from about 0.007" up to about 0.015", and more preferably from about 0.009" up to about 0.013". The printing sleeve was then machined to the requisite outer cylindrically-shaped wall section dimension, employing a lathe.

The dimensional tolerance of the printing sleeve was determined by using a dial indicator to measure the overall axial variation in the diameter of the entire surface of the outer wall section of the printing sleeve. For flexographic printing use, the limited dimensional tolerance of the printing sleeve should be not more than about 0.001. This type of printing is known as process printing. The printing sleeve produced herein met the criteria for process printing use. However, for other uses such as line printing, which includes bread bag printing and the like, a limited dimensional tolerance of not more than 0.0025 is acceptable. Finally, in newsprint applications or the like where fine printing is not a critical parameter, limited dimensional tolerances of not more than about 0.005" can be employed.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A method for axially mounting a cylindrically-shaped printing sleeve onto a complementary cylindrically-shaped printing cylinder and for dismounting said printing sleeve from said printing cylinder, which comprises:

providing said printing sleeve, which is fabricated of a high strength, polymeric laminate material having excellent structural integrity and which is substantially airtight, having a substantially constant cross-sectional configuration, which includes substantially seamless inner and outer cylindrically-shaped wall surfaces, each of said inner and outer wall surfaces having a constant cross-sectional diameter;

expanding said printing sleeve to a diameter slightly greater than the diameter of the printing cylinder;

axially moving said expanded printing sleeve to a position onto said printing cylinder; and contracting said expanded printing sleeve and mounting said printing sleeve onto said printing cylinder to form a minimum interference fit between said printing cylinder and said printing sleeve, respectively.

2. The method of claim 1, wherein said printing sleeve is expanded by introducing a low pressure fluid between said printing sleeve inner wall and said printing cylinder outer wall at a pressure of not more than about 100 psi, and contracting said printing sleeve by removing said low pressure fluid.

3. The method of claim 1, which further comprises providing said printing sleeve having a flexural modulus of at least about $6\times10^5$ lbs/in$_2$.

4. The method of claim 1, which further comprises providing said printing sleeve having a minimum sleeve thickness of not less than about 0.015".

5. The method of claim 1, which further comprises providing said printing sleeve having a stiffness factor of from at least about $7.26\times105$ inch-pounds.

6. The method of claim 1, wherein the dimensional tolerance of the outer wall section is not more than about 0.005".

7. The method of claim 1, which further comprises providing said printing sleeve having a minimum sleeve thickness of not less than about 0.020".

8. A cylindrically-shaped, substantially non-permeable laminate printing sleeve which comprises:

a substantially non-permeable, polymeric laminate printing sleeve body having substantially seamless inner and outer cylindrically-shaped wall surfaces having a constant cross-sectional diameter; and at least one substantially non-permeable internal reinforcement layer with said sleeve body, wherein said cylindrically-shaped non-permeable laminate printing sleeve is readily axially mountable on and dismountable from a cylindrically-shaped printing cylinder having a constant cross-sectional diameter, the diameter of said printing sleeve being expandable by the introduction of a relatively low pressure fluid between said inner printing sleeve wall surface and the outer wall surface of said printing cylinder, and said printing sleeve being contractable by removing said expanding forces and having a flexural modulus of at least about $6\times10^5$ lbs/in$^2$.

9. A method for axially mounting a cylindrically-shaped printing sleeve onto a complementary cylindrically-shaped printing cylinder and for dismounting said printing sleeve from said printing cylinder, which comprises:

providing said printing sleeve, which is fabricated of a non-metallic material and which is substantially airtight, having a substantially constant cross-sectional configuration, which includes substantially seamless inner and outer cylindrically-shaped wall surfaces, each of said inner and outer wall surfaces having a constant cross-sectional diameter, the flexural modulus of said printing sleeve being at least about $6\times10^5$ lbs/in$^2$;

expanding said non-metallic printing sleeve to a diameter slightly greater than the diameter of the printing cylinder;

axially moving said expanded printing sleeve to a position onto said printing cylinder; and contracting said expanded printing sleeve and mounting said printing sleeve onto said printing cylinder to form a minimum interference fit between said printing cylinder and said printing sleeve, respectively.

10. A unitary, cylindrically-shaped printing sleeve, readily axially mountable on and dismountable from a complementary cylindrically-shaped printing cylinder, which comprises a printing sleeve body having a substantially constant cross-sectional diameter and a wall thickness of at least about 0.015 inches, which is substantially airtight when mounted onto said printing cylinder, and which has substantially seamless inner and outer cylindrically-shaped wall surfaces, the diameter of said printing sleeve being expandable by the introduction of a low fluid pressure level between said inner printing sleeve wall surface the outer wall surface of said printing cylinder of not more than about 100 psi at ambient temperature, said printing sleeve being contractable by the removal of said low pressure fluid, and the flexural modulus of said printing sleeve being at least about $6\times10^5$ lbs/in$^2$.

11. The printing sleeve of claim 10, wherein when said sleeve is mounted onto a printing cylinder, each of said respective wall surfaces of said printing sleeve body has a substantially constant radial diameter.

12. The printing sleeve of claim 10, wherein said printing sleeve is fabricated of a non-metallic material.

13. The printing sleeve of claim 12, wherein said non-metallic material comprises a polymeric material.

14. The printing sleeve of claim 10, wherein the wall thickness of said printing sleeve is at least about 0.020.

15. The printing sleeve of claim 10, wherein the stiffness factor of said printing sleeve is from at least about $7.26\times105$ inch-pounds.

16. The printing sleeve of claim 10, which comprises a reinforced non-permeable laminate structure including at least one internal layer of a woven reinforcing fabric comprising either one of synthetic fibers and organic fibers.

17. The printing sleeve of claim 16, wherein said reinforced non-permeable laminate structure further includes at least one non-permeable internal layer comprising synthetic fibers.

18. The printing sleeve of claim 16, wherein said synthetic fibers and said organic fibers are of high strength, and said reinforced non-permeable internal layers comprising a non-woven fabric of synthetic fibers.

19. The printing sleeve of claim 10, wherein said relatively low fluid pressure level is not more than about 80 psi.

20. The printing sleeve of claim 10, wherein the maximum difference in the trueness of the outer wall surface of the printing sleeve, when said printing sleeve is mounted on a true cylinder, is not more than about 0.005".

21. A cylindrically-shaped, substantially non-permeable laminate printing sleeve which comprises:

a substantially non-permeable, high strength polymeric laminate printing sleeve body having excellent structural integrity, and substantially seamless inner and outer cylindrically-shaped wall surfaces having a constant cross-sectional diameter; and at least one substantially non-permeable internal reinforcement layer with said sleeve body, wherein said cylindrically-shaped non-permeable laminate printing sleeve is readily axially mountable on and dismountable from a cylindrically-shaped printing cylinder having a constant cross-sectional diameter, the diameter of said printing sleeve being expandable by the introduction of a relatively low pressure fluid between said inner printing sleeve wall surface and the outer wall surface of said printing cylinder, and said printing sleeve being contractable by removing said expanding forces.

22. The printing sleeve of claim 21, wherein said reinforcement layer comprises a layer of a nonwoven fabric of either one of synthetic fibers and organic fibers.

23. The printing sleeve of claim 21, which further includes at least one internal layer of a reinforcing fabric of high strength fibers.

24. The printing sleeve of claim 23, wherein said reinforcing layer comprises an interwoven fabric of fibers.

25. The printing sleeve of claim 21, wherein said low pressure fluid is introduced at a level of not more than about 100 psi.

26. The printing sleeve of claim 21, wherein the flexural modulus of said printing sleeve is at least about $6\times10^5$ lbs/in$^2$.

27. The printing sleeve of claim 21, wherein the wall thickness of said printing sleeve is at least about 0.015".

28. The printing sleeve of claim 21, wherein the stiffness factor of said printing sleeve is from at least about $7.26\times105$ inch-pounds.

29. A unitary cylindrically-shaped printing sleeve, readily axially mountable on and dismountable from a complementary cylindrically-shaped printing cylinder, which comprises a non-metallic printing sleeve body having a substantially constant cross-sectional diameter and excellent structural integrity, which is substantially airtight when mounted onto said printing cylinder, and which has substantially seamless inner and outer cylindrically-shaped wall surfaces, the diameter of said printing sleeve being expandable by the introduction of a relatively low pressure fluid between said inner printing sleeve wall surface and the outer wall surface of said printing cylinder, said printing sleeve being contractable by the removal of said low pressure fluid and having a stiffness factor of at least about $7.26\times10^5$ inch-pounds.

30. The printing sleeve of claim 29, wherein when said sleeve is mounted onto a printing cylinder, each of said respective wall surfaces of said printing sleeve body has a substantially constant diameter.

31. The printing sleeve of claim 29, wherein said printing sleeve has a thickness of at least about 0.015".

32. The printing sleeve of claim 31, wherein said non-metallic printing sleeve is fabricated of a polymeric material.

33. The printing sleeve of claim 29, which comprises a reinforced non-permeable high strength laminate structure including at least one internal layer of a woven reinforcing fabric of either one of high strength synthetic and organic fibers.

34. The printing sleeve of claim 33, wherein said reinforced non-permeable laminate structure further includes at least one non-permeable internal layer of a nonwoven fabric of synthetic fibers.

35. A unitary cylindrically-shaped printing sleeve, readily axially mountable on and dismountable from a complementary cylindrically-shaped printing cylinder, which comprises a printing sleeve body having a substantially constant cross-sectional diameter and a wall thickness of at least about 0.015 inches, which is substantially airtight when mounted onto said printing cylinder, and which has substantially seamless inner and outer cylindrically-shaped wall surfaces, the diameter of said printing sleeve being expandable by the introduction of a low fluid pressure level between said inner printing sleeve wall surface and the outer wall surface of said printing cylinder of not more than about 100 psi at ambient temperature, said printing sleeve having a stiffness factor of at least about $7.26\times10^5$ inch-pounds and being contractable by the removal of said low pressure fluid.

36. The printing sleeve of claim 21, wherein said polymeric laminate sleeve box comprises a synthetic resin having a high degree of toughness and impact resistance, and a high level of tensile strength.

* * * * *